US010487472B2

(12) United States Patent
McPherson

(10) Patent No.: US 10,487,472 B2
(45) Date of Patent: Nov. 26, 2019

(54) DRAINAGE DEVICES AND SYSTEM

(71) Applicant: Kevin McPherson, Edwardsville, IL (US)

(72) Inventor: Kevin McPherson, Edwardsville, IL (US)

( * ) Notice: Subject to any disclaimer, the term of this patent is extended or adjusted under 35 U.S.C. 154(b) by 0 days.

(21) Appl. No.: 15/886,617

(22) Filed: Feb. 1, 2018

(65) Prior Publication Data

US 2018/0216309 A1 Aug. 2, 2018

Related U.S. Application Data

(60) Provisional application No. 62/453,035, filed on Feb. 1, 2017.

(51) Int. Cl.

| | |
|---|---|
| ***E02D 31/02*** | (2006.01) |
| ***E02D 19/00*** | (2006.01) |
| ***E04B 1/70*** | (2006.01) |
| ***E02D 31/06*** | (2006.01) |
| ***E04B 5/32*** | (2006.01) |

(52) U.S. Cl.

CPC ..... *E02D 31/025* (2013.01); *E02D 19/00* (2013.01); *E02D 31/06* (2013.01); *E04B 1/703* (2013.01); *E04B 1/7023* (2013.01); *E04B 1/7038* (2013.01); *E04B 2005/322* (2013.01)

(58) Field of Classification Search

CPC ..... E02D 31/025; E02D 31/06; E02D 19/00; E04B 1/7023; E04B 1/7038; E04B 1/703; E04B 2005/322; E04B 1/681; E04B 1/665

See application file for complete search history.

(56) References Cited

U.S. PATENT DOCUMENTS

| | | | | |
|---|---|---|---|---|
| 3,888,087 | A * | 6/1975 | Bergsland | E02D 31/02 405/36 |
| 5,044,821 | A * | 9/1991 | Johnsen | E02D 31/02 405/50 |
| 5,775,039 | A | 7/1998 | McPherson | |
| 6,070,370 | A * | 6/2000 | Locke | E04D 13/1407 52/287.1 |
| 6,073,400 | A * | 6/2000 | Balisle | E04D 13/0459 52/302.6 |
| 6,672,016 | B2 * | 1/2004 | Janesky | E02D 31/06 405/38 |
| 7,735,291 | B2 * | 6/2010 | Summy | E06B 1/62 52/302.6 |
| 7,810,291 | B2 * | 10/2010 | McPherson | E02D 31/02 404/2 |
| 7,918,055 | B2 * | 4/2011 | Cotten | E04B 1/7023 52/169.14 |
| 9,151,039 | B2 * | 10/2015 | Fechino | E04B 1/7038 |

(Continued)

*Primary Examiner* — Rodney Mintz
(74) *Attorney, Agent, or Firm* — Sitnson LLP

(57) ABSTRACT

A drainage device for use under the floor of a building to facilitate drainage of water along a foundation of the building under the floor. The drainage device can include a corner drainage device that is capable of assuming a number of near 90 degree shapes so that the drainage device can be easily fitted to the corner of the foundation. A bridge drainage device permits more rapid installation of the drainage devices. The bridge device can be used to bridge between two drainage devices so that it is not necessary to cut the drainage devices precisely to fit on a footing of any selected length.

20 Claims, 17 Drawing Sheets

(56) References Cited

U.S. PATENT DOCUMENTS

| | | | | |
|---|---|---|---|---|
| 2002/0139068 | A1* | 10/2002 | Janesky | E02D 31/06 52/169.5 |
| 2005/0055890 | A1* | 3/2005 | Summy | E06B 1/62 52/58 |
| 2006/0137289 | A1* | 6/2006 | Cotten | E02D 31/02 52/717.02 |
| 2009/0183445 | A1 | 7/2009 | McPherson | |
| 2014/0215931 | A1* | 8/2014 | Fechino | E04B 1/7038 52/61 |

* cited by examiner

DRAINAGE DEVICES AND SYSTEM

BACKGROUND

The present disclosure relates generally to drainage systems and more particularly to drainage devices for use in providing a flow path below basement floors for water seeping in between foundation walls and footing to prevent water leakage onto basement floors.

A problem in many basements is wet or damp basement floors caused by water seeping under the foundation wall and flowing up between the foundation wall and the basement floor. It is not practical, or even desirable, to prevent water from seeping under the foundation wall. Water pressure build-up behind the wall can damage the wall. Therefore, drainage systems are used to provide a flow path for water entering between the foundation wall and footing to a sump, thus preventing the water from flowing up between the foundation wall and basement floor.

SUMMARY

In one aspect, a corner drainage device generally comprises a first wall member having a foundation section and a footing section, and a second wall member having a foundation section and a footing section. A first hinge joins the first and second wall members to permit pivoting of one of the first and second wall members relative to the other of the first and second wall members to form a corner at the first hinge. The footing section of the second wall member includes an overlap portion configured to overlap the footing section of the first wall member when the first hinge forms the corner, the overlap portion configured to overlap the footing section of the second wall member in closely conforming engagement at infinite increments of overlap to permit formation the corner at the first hinge.

In another aspect, drainage system that is for use under a floor in a structure including the floor, a foundation wall, and a footing located below the foundation wall The drainage system generally comprises a first drainage device configured to fit on the footing adjacent the foundation. The first drainage device is formed with a series of feet projecting down from the first drainage device for spacing the first drainage device off of the footing to permit water to flow under the first drainage device. A second drainage device is configured to fit on the footing overlapping and to be nested with the first drainage device. The second drainage device is formed with a series of feet projecting down from the second drainage device for spacing the second drainage device off of the footing to permit water to flow under the second drainage device. A third drainage device is configured to fit on the footing adjacent the second drainage device. The third drainage device is formed with a series of feet projecting down from the third drainage device for spacing the third drainage device off of the footing to permit water to flow under the third drainage device. A bridge drainage device is configured to bridge the second and third drainage devices, and is formed with smooth surfaces to prevent nesting engagement with the feet of at least one of the second and third drainage devices.

In still another aspect, a bridge drainage device that is for use under a floor in a structure including the floor, a foundation wall, and a footing located below the foundation wall to bridge between first and second drainage devices. The bridge drainage device is constructed for placement on the first and second drainage devices on the footing adjacent the foundation wall prior to installation of the floor to permit water to flow along the footing under the floor. The bridge drainage device generally comprises a wall member for bridging the first and second drainage devices. The wall member has a first surface facing away from the footing and foundation wall when the bridge drainage device is placed on the drainage devices on the footing, and a second surface facing generally toward the footing and the foundation wall when the bridge drainage device is placed on the drainage devices on the footing. The wall member comprising a wall section for facing the foundation wall and a footing section for facing the footing, the wall member being free of protrusions for nesting with at least one of the first and second drainage devices.

BRIEF DESCRIPTION OF THE DRAWINGS

Corresponding reference characters indicate corresponding parts throughout the several views of the drawings.

DETAILED DESCRIPTION

Figure 1:
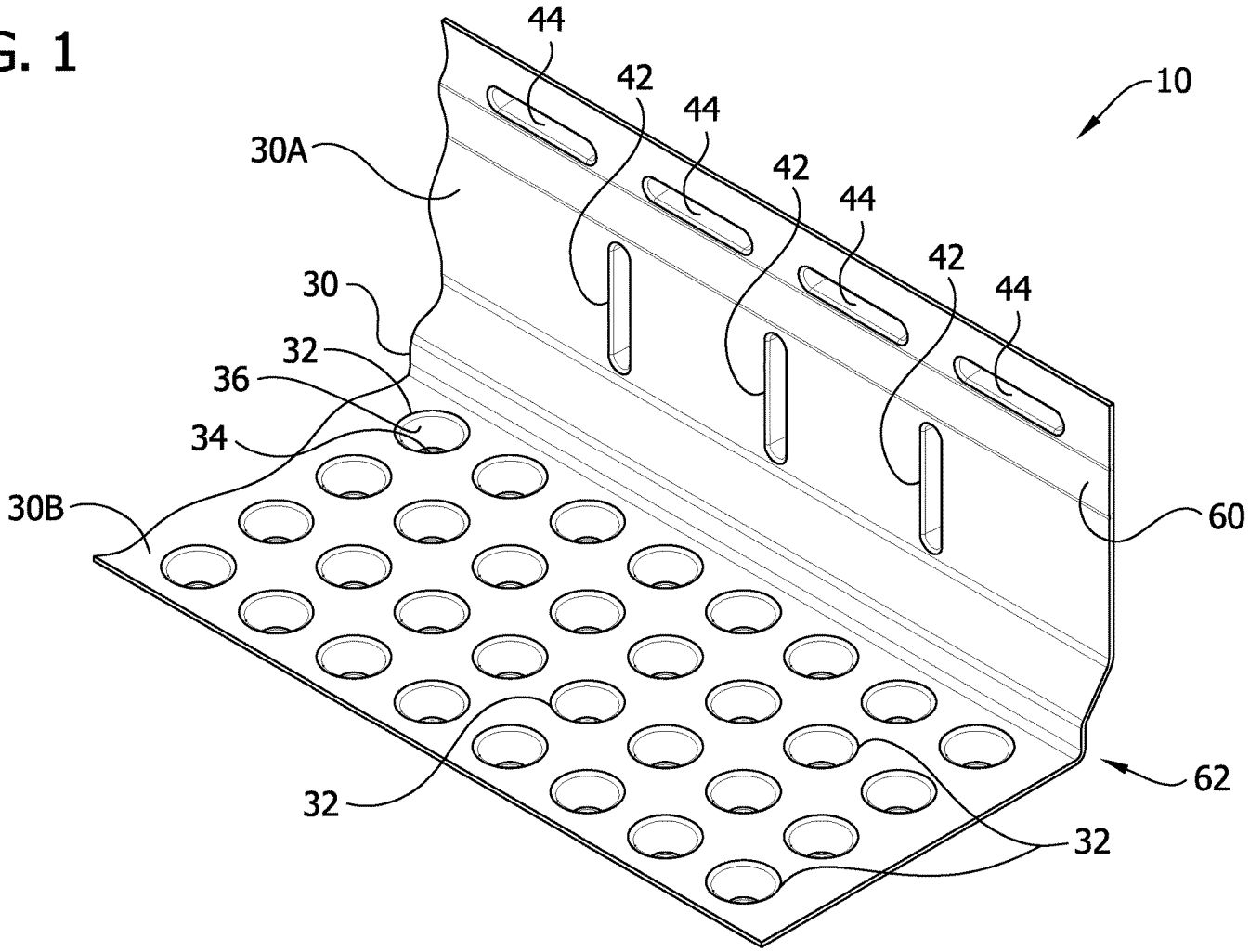
FIG. 1 is a fragmentary perspective of a drainage tile.

Referring now to the drawings, and first to FIGS. 1-4, there is generally indicated at 10 a drainage tile of this invention (broadly, "drainage device"). The drainage tile 10 is for use under a floor 12 in a structure (e.g., a residence) including the floor, a foundation wall 14, and a footing 16 located below the foundation wall (see, FIG. 4). A drain or sump (not shown) may be located along the foundation to receive the drained water. The drainage tile 10 is constructed for placement on the footing 16 adjacent to the foundation wall 14 prior to installation of the floor 12 to permit water to flow along the footing under the floor. The structure can be formed in a conventional manner with the footing 16 and foundation wall 14 typically formed of concrete. As will be understood by those of ordinary skill in the art, other materials can be used. For example, cinder blocks (not shown) may be used for the foundation wall. The footing 16 extends around the perimeter of the structure and supports the foundation wall 14. The footing 16 also extends beyond the foundation wall into the interior of the structure for supporting a peripheral edge of the basement floor 12 at the outer perimeter of the floor. The remaining portion of the floor 12 is supported by a layer of gravel and dirt generally indicated at 20. The drainage tile 10 may be used in buildings such as residential houses, commercial buildings, factories or any other building having a similar structural arrangement.

Figure 2:
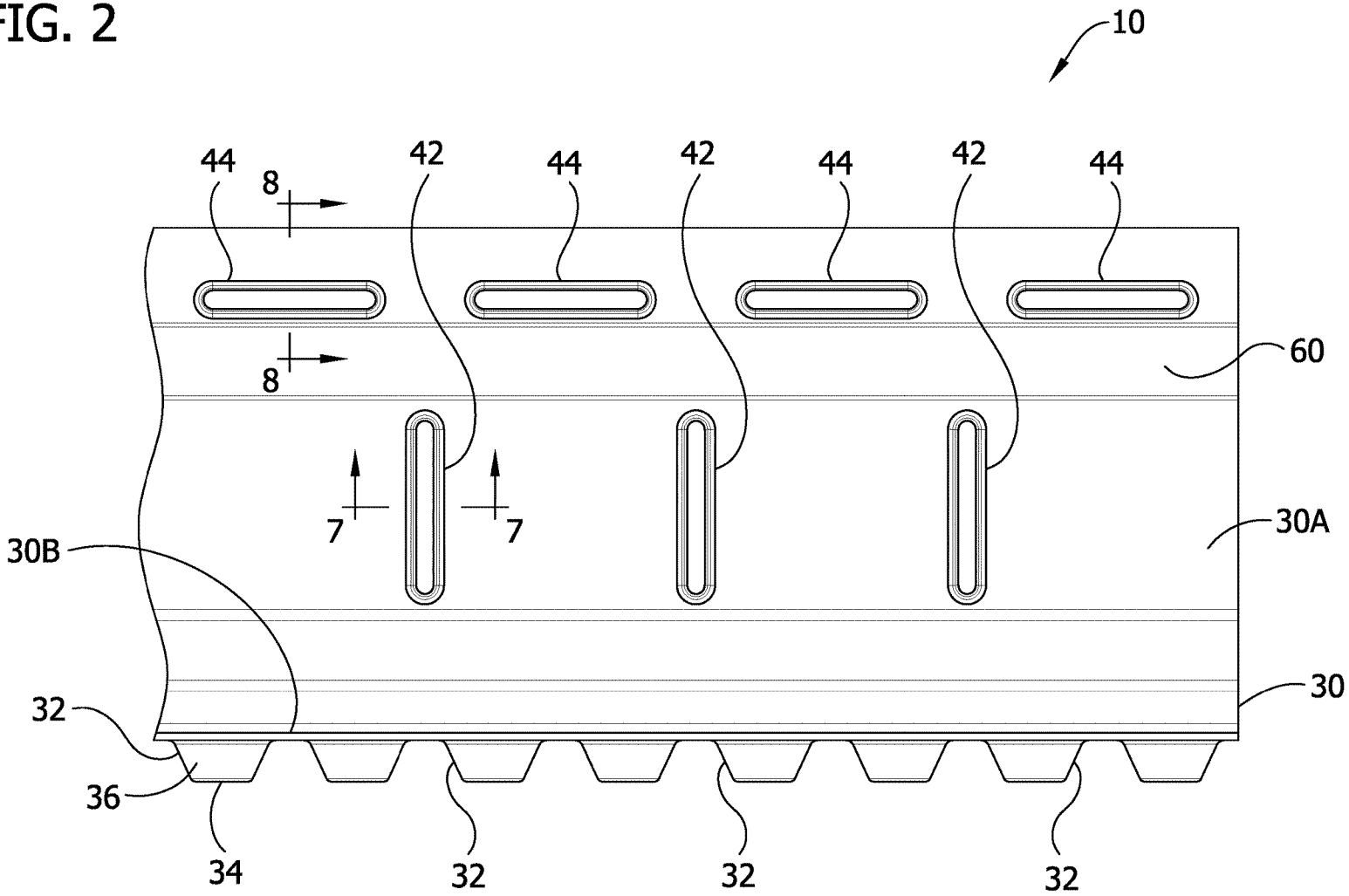
FIG. 2 is a fragmentary front elevation thereof.
Figure 3:
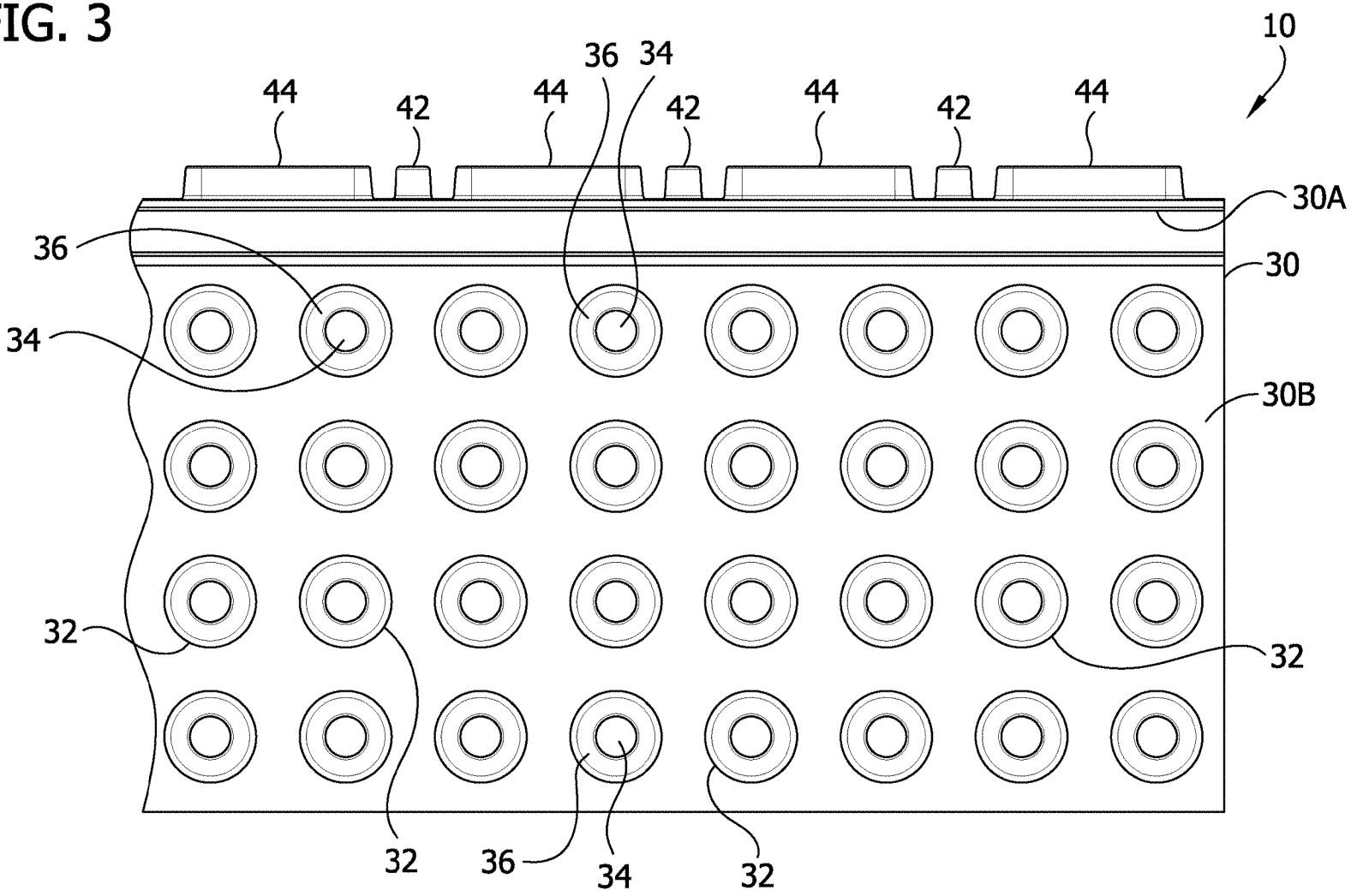
FIG. 3 is a fragmentary top view thereof.
Figure 4:
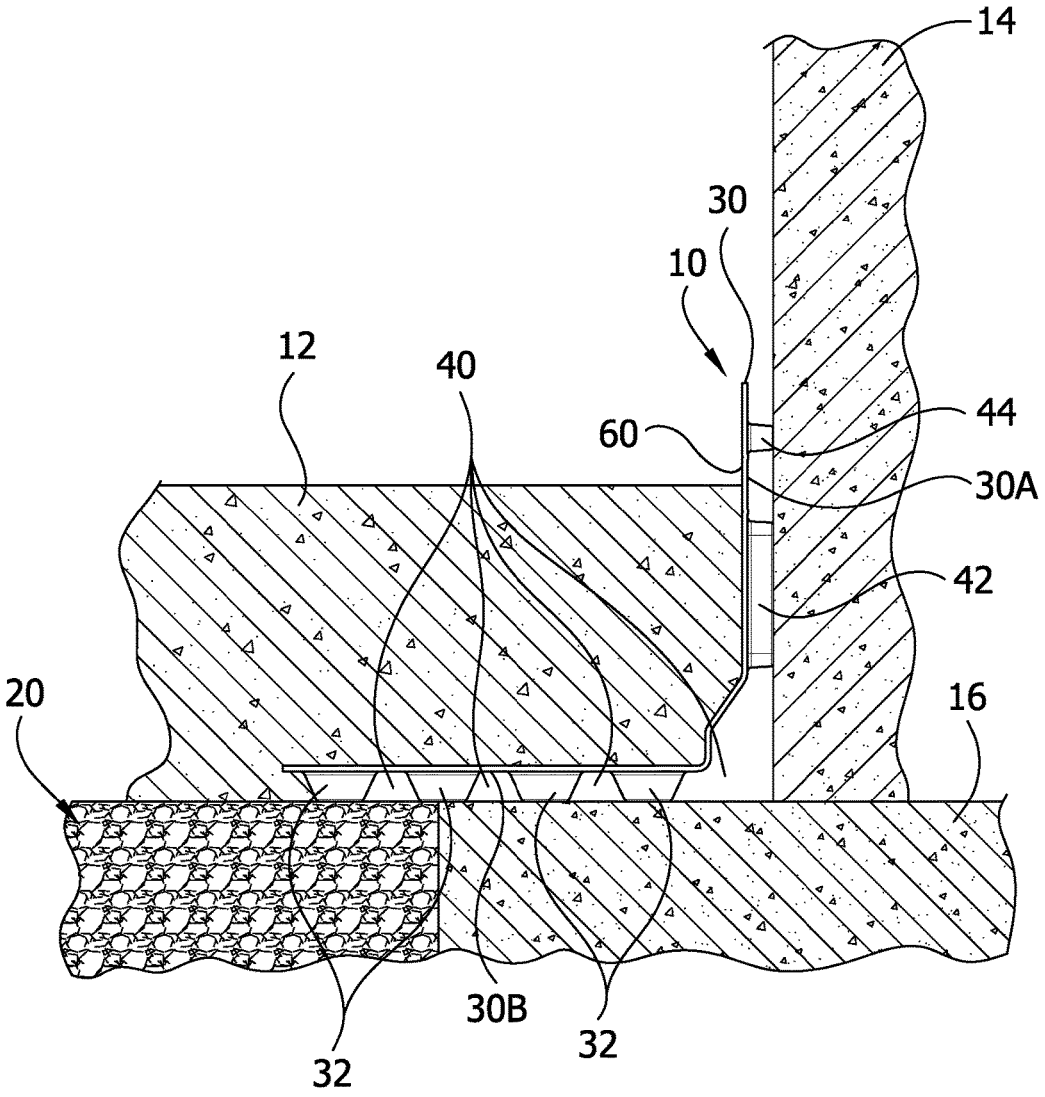
FIG. 4 is a side elevation of the drainage tile as installed on a footing of a foundation of a structure.

The drainage tile 10 comprises a wall member 30 including a wall section 30A that is located adjacent to the foundation wall 14, and a footing section 30B that is located generally adjacent to the footing when the drainage tile is placed on the footing. The wall section 30A and the foot section 30B are connected together by a hinge 62 that permits bending of the wall and foot sections relative to each other about a longitudinal axis of the drainage tile 10. In one embodiment, the angle between the wall section 30A and the footing section 30B is about 115°. Other angles may be used within the scope of the present invention, but there is some advantage to having the angle be greater than 90° so that the wall sections 30A, 30B are deflected from a relaxed condition as installed on the footing 16. A first surface of the wall member 30 faces generally away from the foundation wall 14 and/or footing 16, and a second surface of the wall member faces generally toward the foundation wall and/or footing. The wall member 30 includes protrusions that project outwardly from the second surface of the wall member and open at the first surface. The protrusions include spaced apart feet 32 depending from the footing section 30B of the wall member 30. The feet 32 are hollow and open upwardly through the first surface of the wall member 30 for receiving material poured to form the floor 12 whereby the weight of the floor is supported by the floor material within the feet and not by the wall member. Each foot 32 comprises a bottom wall 34 and a sidewall 36 which is generally frustoconically shaped (although the sidewall may having other shapes such as cylindrical), as can be seen in FIGS. 2 and 4. It is to be understood that the feet 32 may be rectangular or other suitable shapes without departing from the scope of this invention. The bottom walls 34 of the feet 32 are generally parallel with the wall member 30 and are engageable with the footing 16 at spaced apart locations for vertically spacing the wall member from the footing.

The feet 32 define fluid flow channels 40 for water seeping from between the foundation wall 14 and the footing 16 and allow water to flow freely underneath the floor 12 and along the footing, either into the gravel or to the drain. The placement of the feet 32 is such that the flow channels 40 allow water to travel both longitudinally and laterally with respect to each foundation wall 14. The size and number of feet 32 may vary as long as there is enough surface area provided by the feet to allow for adequate support for the wall member 30 upon pouring the floor material over the drainage tiles 10. It is to be understood that the feet 32 may vary in size and spacing without departing from the scope of this invention. The height of the feet 32 should be sufficient to provide adequate flow rates through the flow channels 40 so that under worst case conditions the water will be permitted to flow freely without causing pressure to build up due to water entering the structure at a faster rate than it can be removed. The wall member 30 and feet 32 are desirably integrally formed from a thin (e.g., 0.04 in.) single sheet of material (e.g., polyethylene terephthalate glycol-modified, "PETG" plastic). The drainage tile 10 may be formed from a polymeric material or other suitable material which is impervious to water and strong enough to retain its shape after the concrete floor is poured and until the floor 12 sets. The drainage tile 10 is preferably sized to extend outwardly beyond the footing 16 so that a portion of the drainage tile 10 covers the rock 20 to permit flow of water between the footing and the rock (FIG. 4). The drainage tile 10 may be formed of a material capable of transmitting light in the visual range or may be opaque.

The wall section 30A of the of the wall member 30 also has protrusions in the form of vertical, elongate channels 42 and horizontal, elongate channels 44 spaced along the length of the drainage tile 10. As will be explained more fully below, the vertical and horizontal channels 42, 44 constitute "connecting protrusions" in the illustrated embodiment. The use of the terms "vertical" and "horizontal" are for convenience and describe the position of the channels 42, 44 when the drainage tile 10 is installed on the footing 16. However, channels may have other orientations without departing from the scope of the present invention. For example, the channels may be other than vertical and horizontal, the channels may all be oriented in the same direction, or some channels may be eliminated altogether. Still further and without limiting the generality of the disclosure, the channels may not necessarily be elongate, and may have different shapes from each other.

Figure 7:
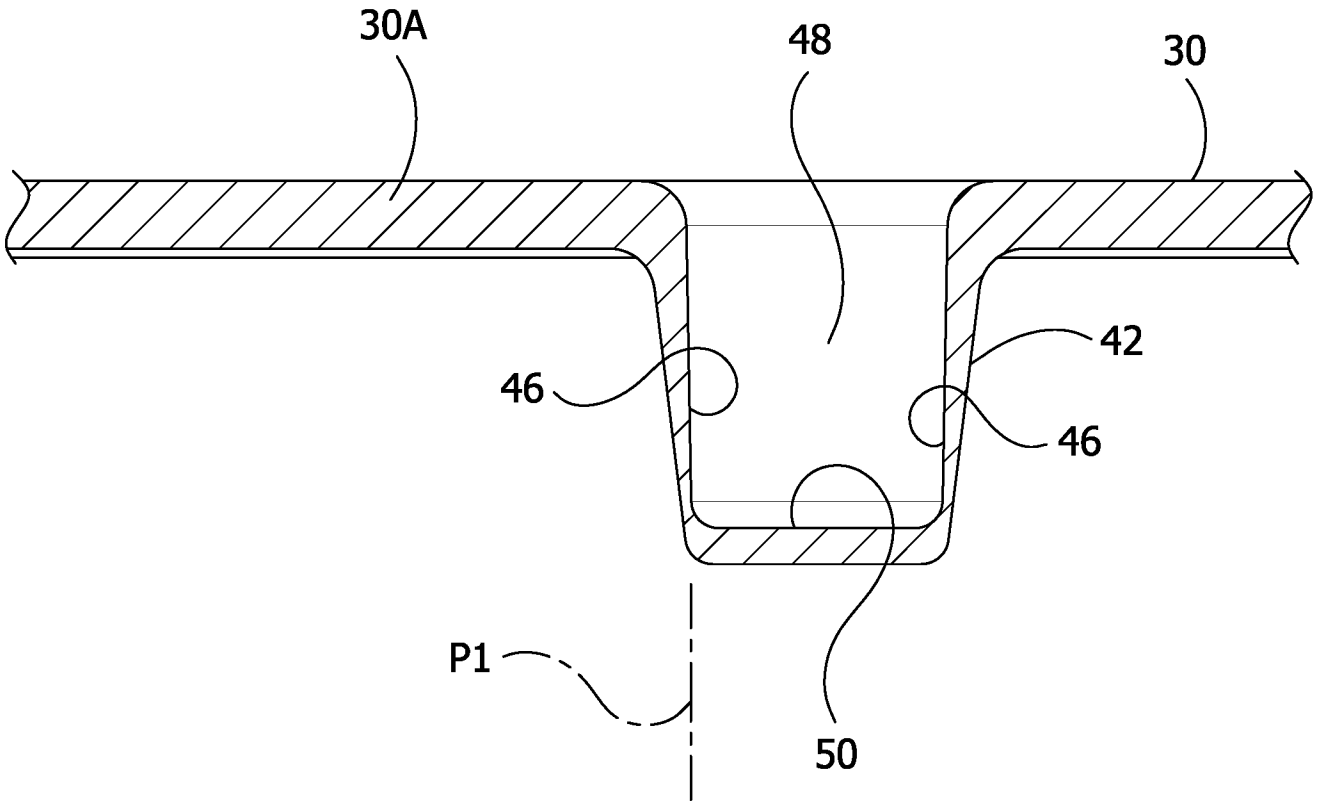
FIG. 7 is a fragmentary section taken in the plane including line 7-7 of FIG. 2.
Figure 8:
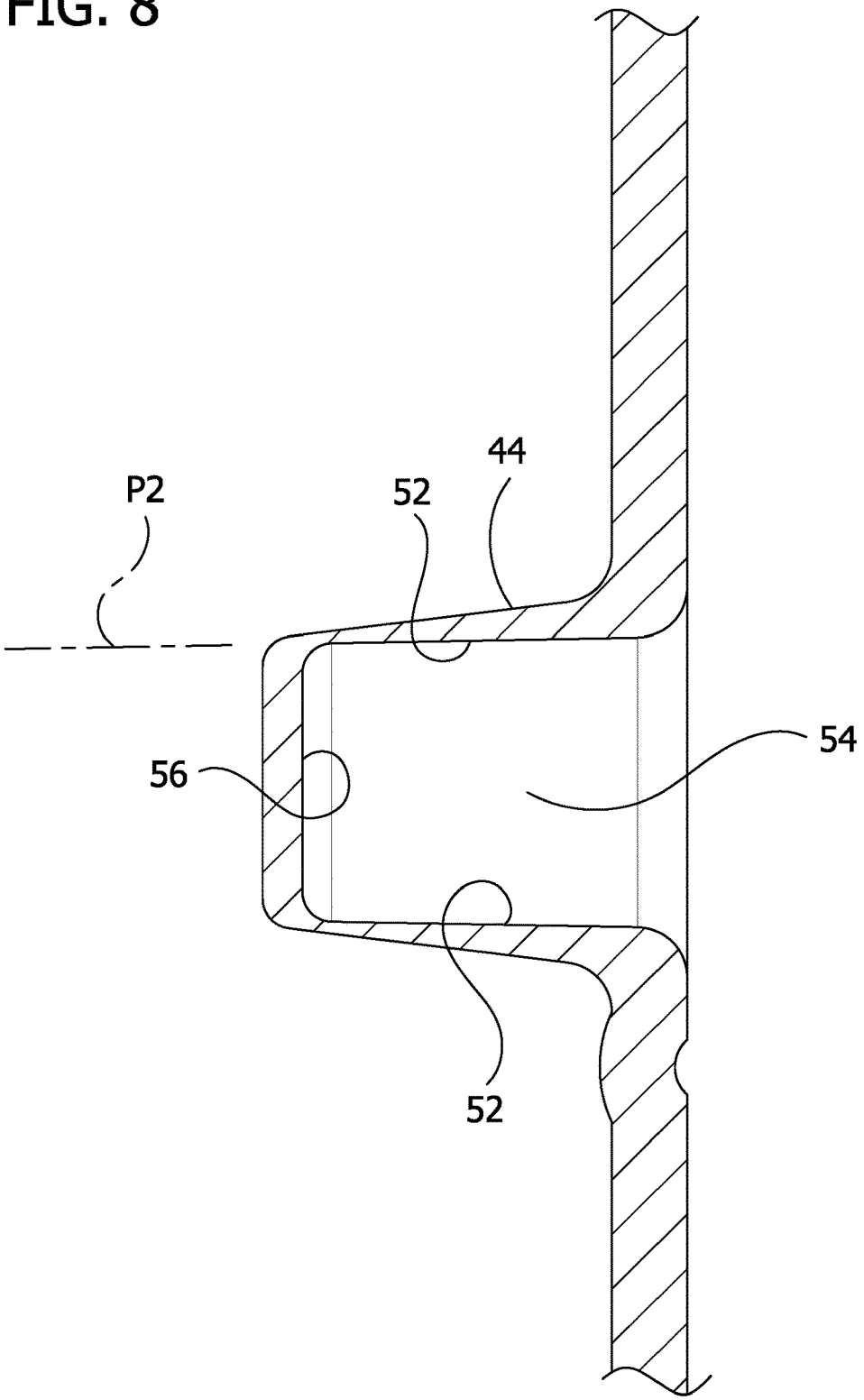
FIG. 8 is a fragmentary section taken in the plane including line 8-8 of FIG. 2.

As shown in FIG. 7, the vertical channels 42 each have side walls 46, end walls 48 (only one is shown) and a bottom wall 50. The angle that the side walls 46 make with a plane P1 perpendicular to the second surface of the wall member 30 and roughly parallel to the side wall is preferably small. For example, in one embodiment, the angle may range from 0° to 45°, in another embodiment may range from 0° to 15°, and in still another embodiment may range from 0° to 10°. It is understood that some small angle may be necessary to get the drainage tile 10 out of a mold (not shown) in which it is formed, but otherwise the angle is most preferably close to 0° (or 90° from the wall section 30A), which is what is illustrated in FIG. 7. As a result, the opening of each vertical channel 42 at the first surface of the wall section 30A of the wall member 30 is nearly the same size as (but very slightly larger than) the bottom wall 50. In the illustrated embodiment, the end walls 48 each make a similar angle with respect to a plane (not illustrated) perpendicular to the second surface of the wall member 30 and tangent to the end wall. However, it is not necessary for both walls to make the same angle. For instance, the upper one of the end walls 48 may make a greater angle than the lower one of the end walls. As shown in FIG. 8, the horizontal channels 44 each have side walls 52, end walls 54 and a bottom wall 56 similar to the construction of the vertical channels 42. The side walls 52 preferably make an angle with a plane P2 that is perpendicular to the second surface of the wall section 30A of the wall member 30 and roughly parallel to the side wall that is small. The ranges of angles given for the vertical channel 42 may be applied to the horizontal channels 44, and the illustrated angle is about 0°. The walls do not all need to have the same angle. For example, the upper one of the side walls 52 may have a greater angle than the lower one of the side walls. Again the opening of the horizontal channel 44 at the first surface of the wall member 30 is very nearly the same size (but probably slightly larger than) the bottom wall 56 of the horizontal channel. It will be noted that the exterior surfaces of the vertical channels 42 and the horizontal channels 44 are tapered toward the bottom walls 50, 56 (e.g., they make a non-zero angle with respective planes P1 and P2). This facilitates nesting of channels as will be described. In the illustrated embodiment, the vertical channels 42 are about 2⅛ inches long and about ⅜ inches wide. The horizontal channels 44 are about 1¾ inches long and ⅜ inches wide. It is to be understood that these dimensions are exemplary only, and the channels 42, 44 may have other dimensions within the scope of the present invention.

Figure 5:
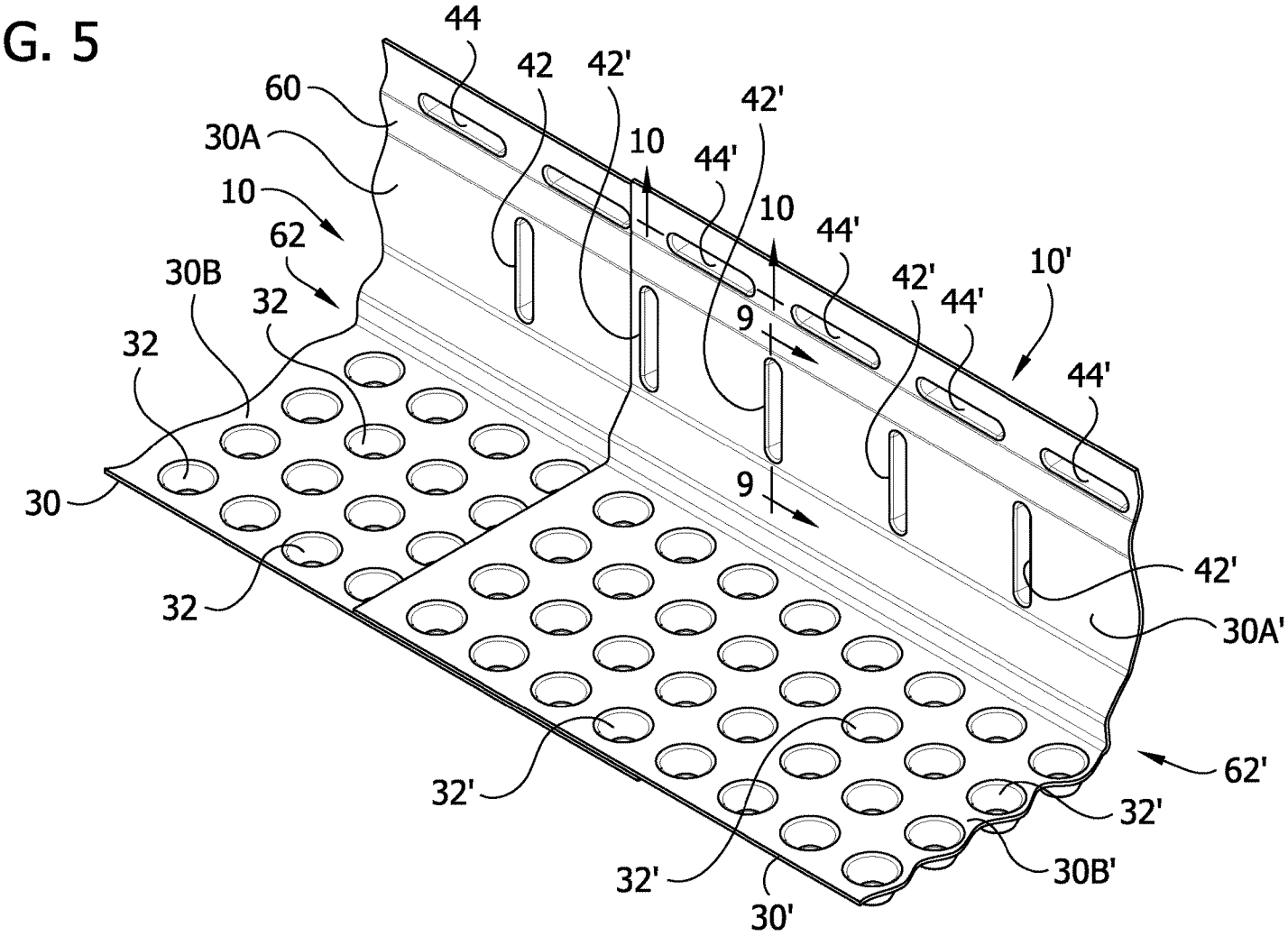
FIG. 5 is a fragmentary perspective of two, overlapped drainage tiles.
Figure 6:
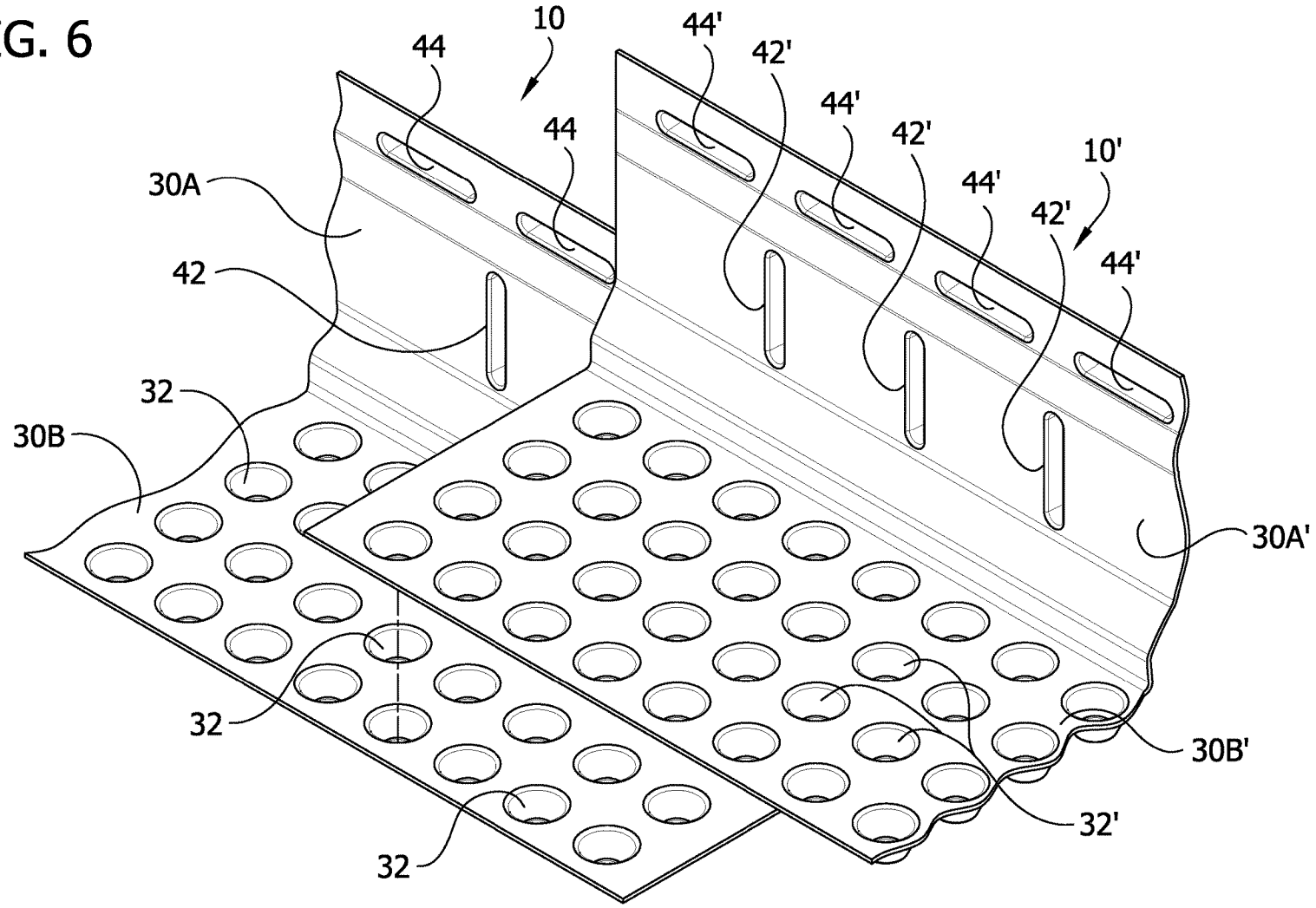
FIG. 6 is the perspective of FIG. 5, but with the drainage tiles exploded from one another.
Figure 9:
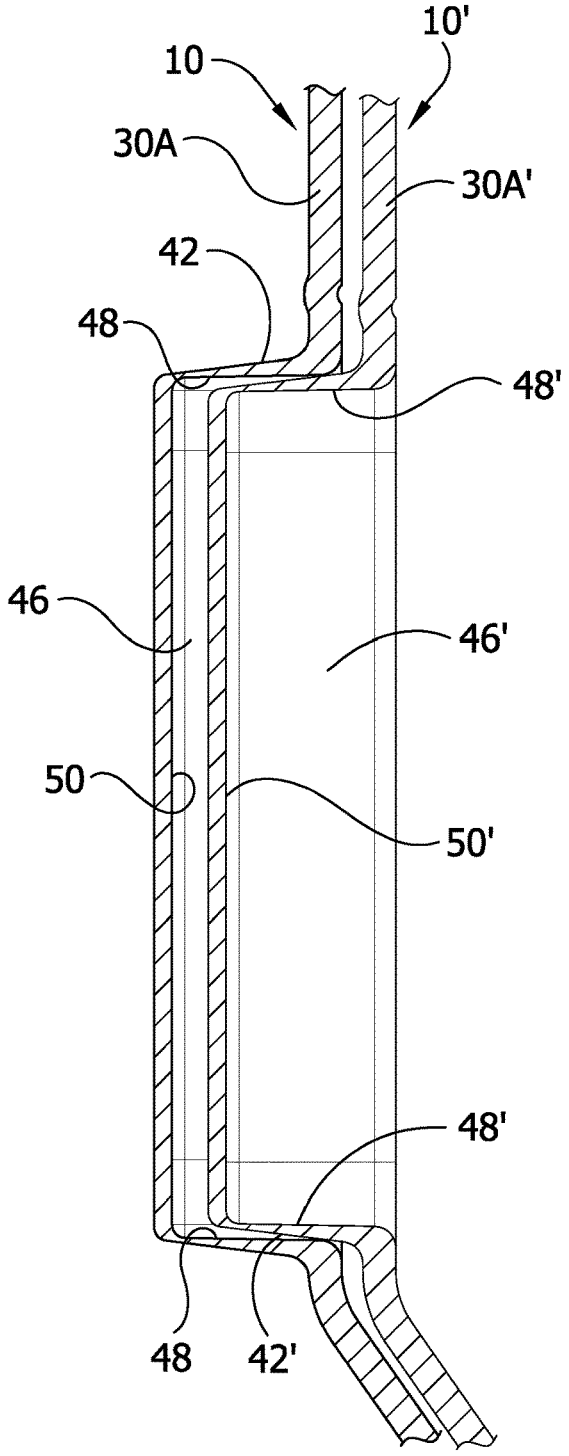
FIG. 9 is a fragmentary section taken in the plane including line 9-9 of FIG. 5.
Figure 10:
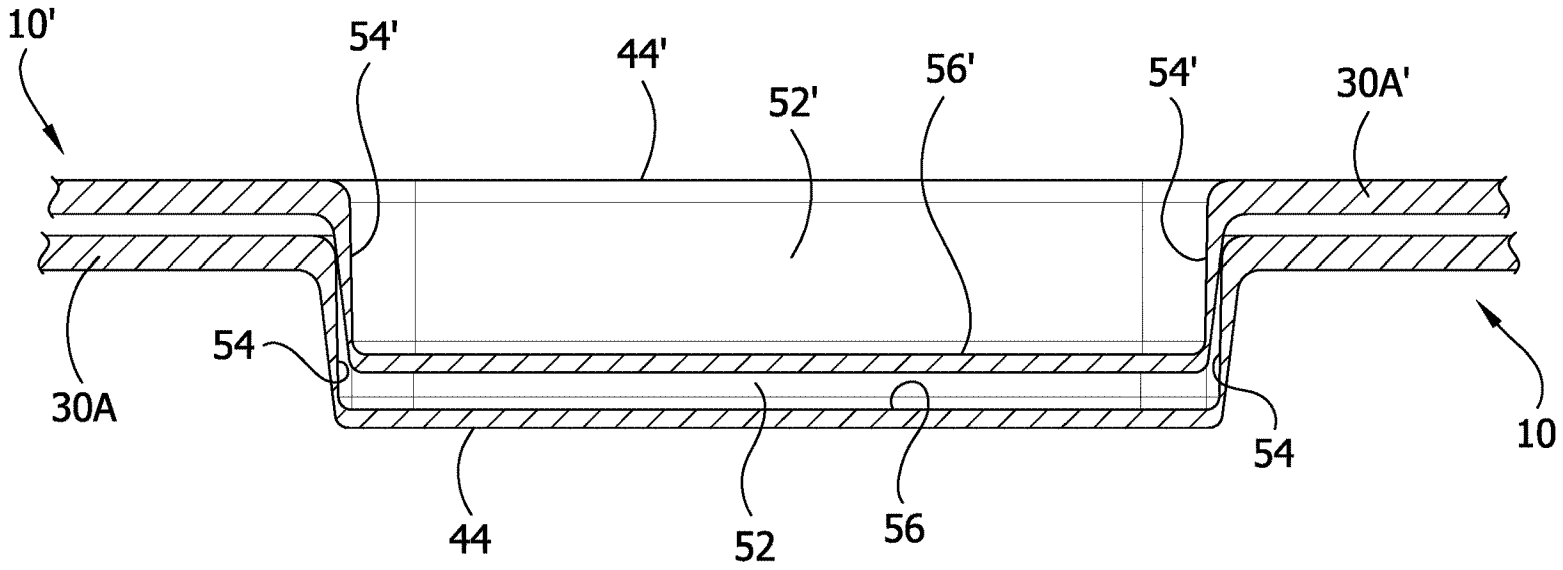
FIG. 10 is a fragmentary section taken in the plane including line 10-10 of FIG. 5.

Referring now to FIGS. 5, 9 and 10, it may be seen that the foregoing construction facilitates a snug, interference fit of the vertical channel 42 of the drainage tile 10 with another drainage tile 10' that has the same construction as the drainage tile 10. The slight taper of the exterior walls of the channels 42' help to permit the channels 42' of the drainage tile 10' to be initially received in the channels 42 of the drainage tiles 10. A longitudinal end margin of the drainage tile 10' is overlapped with a longitudinal end margin of the drainage tile 10 as shown in FIG. 5 to form a continuous drainage tile surface along the footing 16. Positioning of the drainage tiles 10, 10' just prior to being interconnected is illustrated in the exploded view of FIG. 6. The drainage tile 10, 10' has a length (e.g., 6 feet or various other lengths) that is shorter than the length of the footing 16, so overlapping of the drainage tiles is convenient to produce an uninterrupted drainage tile span over the full length of the footing 16. It is to be understood that multiple drainage tiles can be secured together, end-to-end in this manner to cover the entire footing 16. As shown in FIG. 9, two of the vertical channels 42' of the drainage tiles 10' are received in corresponding vertical channels 42 of the drainage tile 10. Similarly, two of the horizontal channels 44' of the drainage tile 10' are received in corresponding ones of the horizontal channels 44 of the drainage tile 10.

Desirably, the fit of the vertical channels 42' of the drainage tile 10' in the corresponding vertical channels 42 of the drainage tile 10 and the fit of the horizontal channels 44' in the horizontal channels 44 is such that there is interference between the nested vertical channels 42, 42' and horizontal channels 44, 44' that prevents the channels from being separated without the application of some considerable manual force. For example in one embodiment, it is possible after the connection is made to pick up either one of the drainage tiles 10, 10' so that the overlap is lifted off the ground and turned upside down without losing the connection. It is believed that the orientation of the end walls 48, 48' of the vertical channels 42, 42' and the side walls 52, 52' of the horizontal channels 44, 44' is particularly helpful in preventing the drainage tile 10' from sliding upward with respect to drainage tile 10. The feet 32, 32' of the overlapping sections also nest in this arrangement, but do not provide an interference fit. The interference fit of the vertical and horizontal channels 42, 42', 44, 44' holds the feet 32, 32' of the overlapping sections in the nested configuration. In turn, the feet 32, 32' hold the drainage tiles 10, 10' from substantial relative movement in a plane parallel to the footing. Together, this keeps the overlapping sections of the tiles 10, 10' from separating which could cause concrete to move between the tiles, which is undesirable. It is to be understood that not both of the vertical channels 42, 42' and the horizontal channels 44, 44' need to have an interference fit.

The drainage tile 10 further includes a finish surface 60 that is located between the vertical channels 42 and the horizontal channels 44. The finish surface 60 extends the length of the drainage tile 10 and is about one inch in height. The configuration of the finish surface 60 may be other than described within the scope of the present invention. However, it is desirable to have a smooth, flat surface that is located where the top surface of the concrete floor 12 intersects the drainage tile 10 (see, FIG. 4). This makes it easier to achieve a clean, neat finish of the concrete next to the drainage tile 10. The vertical location of the finish surface 60 is preferably such that it is at a height above the footing 16 corresponding to the standard thickness of the concrete floor 12. After the floor 12 is poured and cured, the part of the drainage tile 10 above the top surface of the floor 12 can remain. The portion of the wall section 30A above the floor 12 can serve to prevent debris from entering between the foundation wall 14 and end of the floor. Debris could block water flow down the wall 14. Moreover, the portion of the wall section 30A above the floor 12 could be used to resiliently capture a lower edge of a sheet plastic (not shown) that is put over the foundation wall 14 to create a barrier for insulation or finishing construction put over the wall.

Figure 11:
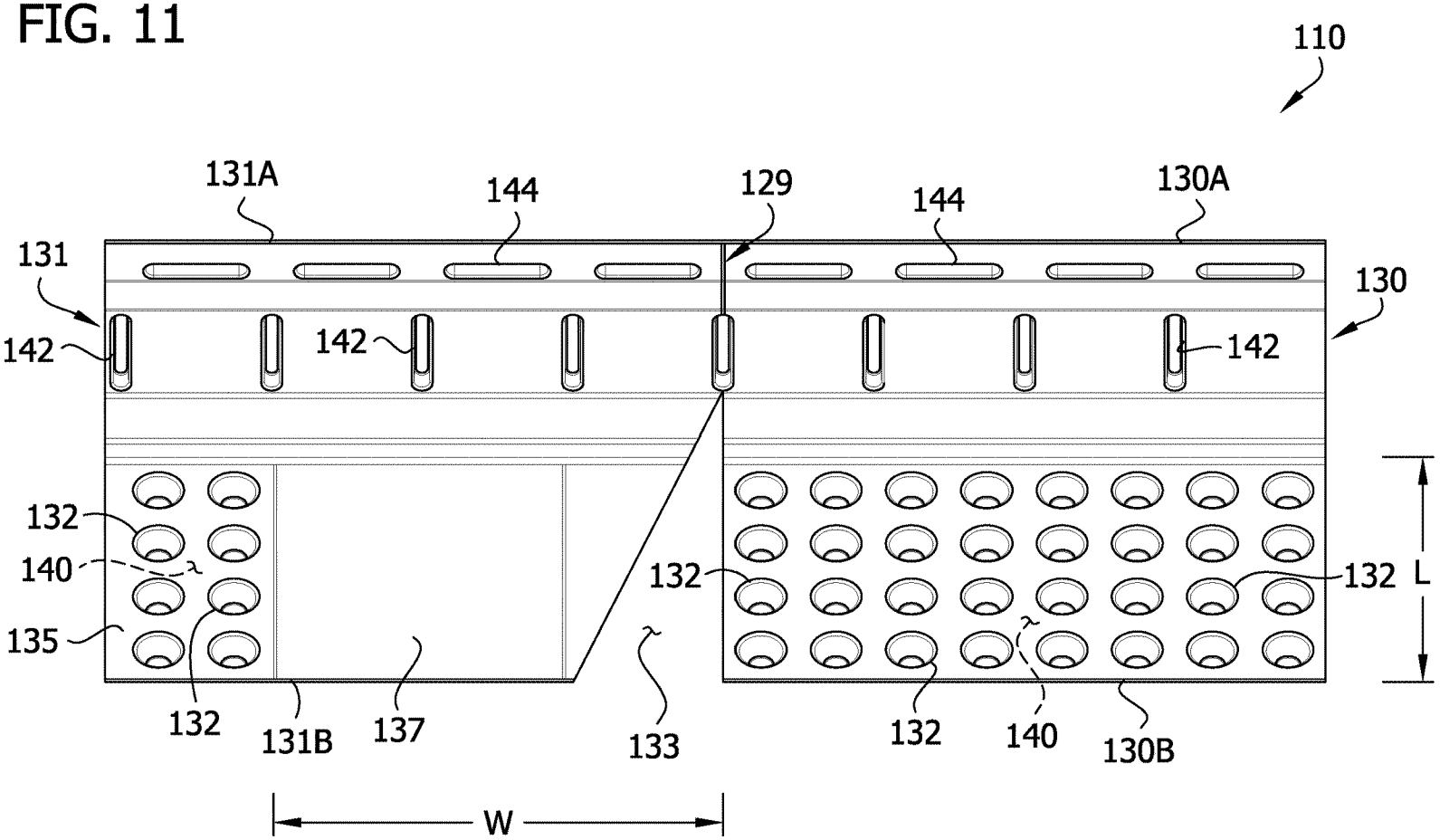
FIG. 11 is a perspective of a corner drainage tile.
Figure 12:
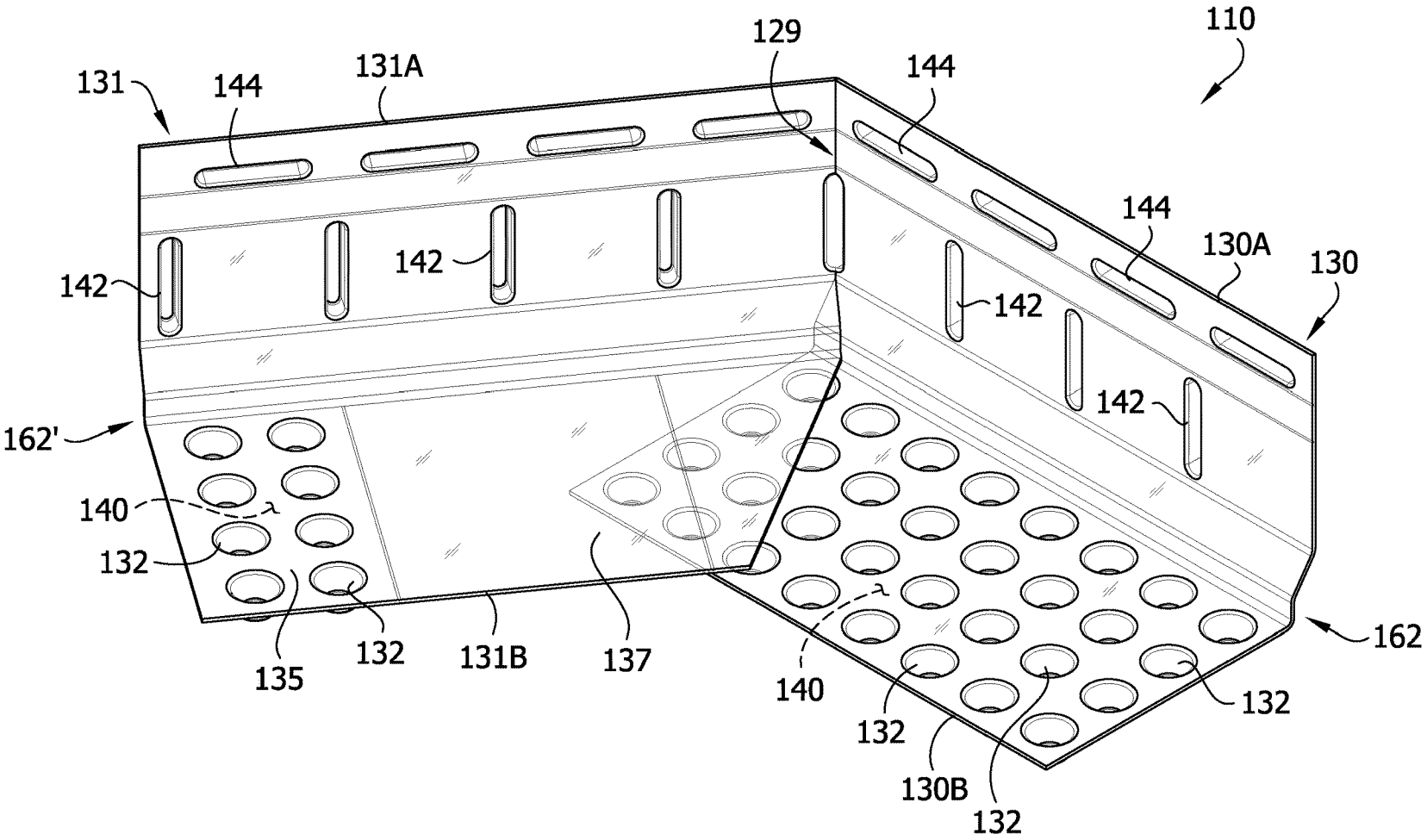
FIG. 12 is a perspective of the corner drainage tile of FIG. 11 in a first folded configuration.
Figure 13:
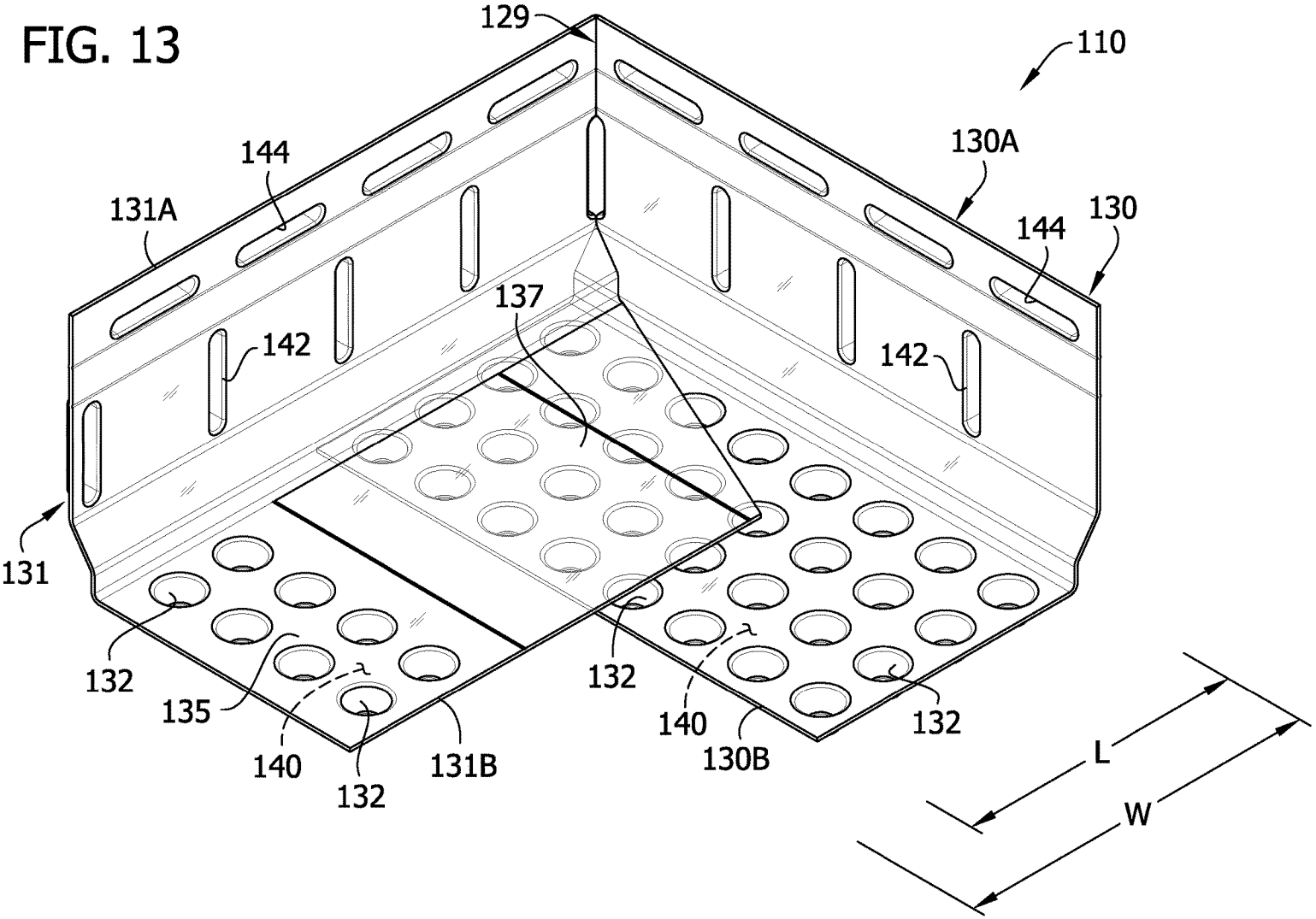
FIG. 13 is a perspective of the corner drainage tile in a second folded configuration.

Referring now FIGS. 11-13, there is generally indicated at 110 a corner drainage tile (broadly, "corner drainage device"). Like the drainage tiles 10, 10' described above, the corner drainage tile 110 is for use under a floor 12 in a structure (e.g., a residence) including the floor, a foundation wall 14, and a footing 16 located below the foundation wall. As will become apparent, the corner drainage tile 110 is configured for use with the drainage tiles 10, 10' for forming a drainage tile system. The corner drainage tile 110 is constructed for placement on the footing 16 at a foundation wall corner (i.e., corner formed by two foundation walls 14) prior to installation of the floor 12 to permit water to flow along the footing under the floor. As shown in FIG. 11, the corner drainage tile 110 has an unfolded configuration, and, as shown in FIGS. 12, and 13, the corner drainage tile is foldable to form corners of various angles (e.g., about 150 degrees in FIG. 12, and about 90 degrees in FIG. 13) as needed for conforming application to a foundation wall corner. It is not uncommon for the intersecting walls at a corner to vary from a true 90 degree angle. The corner drainage tile 110 can be adjusted to file a range of angles without loss of continuity of the tile in the corner. The corner drainage tile 110 is configured to connect with adjacent drainage tiles 10, 10' for forming a continuous drainage tile system, like explained above with respect to the drainage tiles 10, 10'.

The corner drainage tile 110 can be formed from a thin (e.g., 0.04 in.) single sheet of material (e.g., polyethylene terephthalate glycol-modified, "PETG" plastic). The corner drainage tile 110 may be formed from a polymeric material or other suitable material which is impervious to water and strong enough to retain its shape after the concrete floor 12 is poured and until the floor sets. The corner drainage tile 110 is preferably sized to extend outwardly beyond the footing 16 so that a portion of the drainage tile 110 covers the rock 20 to permit flow of water between the footing and the rock.

Referring to FIG. 11, the corner drainage tile 110 includes a right (first) wall member 130 and a left (second) wall member 131. A (first) hinge 129 connects the right and left wall members 130, 131, and the drainage tile is foldable about the hinge (i.e., one wall member can pivot relative to the other wall member about the hinge) to configure the corner drainage tile to correspond to a selected foundation wall corner. In the illustrated embodiment, the hinge 129 is a living hinge joining the integrally formed right (first) and left (second) wall members 130, 131. Each wall member 130, 131 includes a respective wall section 130A, 131A that is located adjacent to the foundation wall 14, and a footing section 130B, 131B that is located generally adjacent to the footing when the corner drainage tile is placed on the footing. A (second) hinge 162 connects the wall section 130A to the foot section 130B and a similar hinge 162' connects the wall section 131A to the foot section 131B. The hinge 129 joins the wall sections 130A, 131A and not the footing sections 130B, 131B. In the unfolded configuration shown in FIG. 11, the footing sections 130B, 131B are separated by a cutout or gap 133. The hinge 129 extends from an upper end of the wall sections 130A, 131A downward to the gap 133. In the illustrated embodiment, the width of the gap 133 increases as the gap extends away from the lower end of the hinge 129. The gap 133 has a relatively small width adjacent the hinge 129, and the right edge of the footing section 131B tapers away from the left edge of the footing section 130B such that the gap has a relatively larger width spaced from the hinge 129. As shown in FIG. 13, the arrangement is such that the corner drainage tile 110 can be folded about the hinge 129, with the footing section 131B overlapping the footing section 130B, without the right edge of the footing section 131B contacting the wall section 130A, which might cause interference in folding the corner drainage tile to form an angle of about 90 degrees.

First surfaces of the wall members 130, 131 face generally away from the foundation wall 14 and/or footing 16, and second surfaces of the wall members face generally toward the foundation wall and/or footing. The footing sections 130B, 131B each include protrusions 132 that project outwardly from the second surface of the wall member 130, 131 and open at the first surface. The protrusions 132 can be referred to as spaced apart feet (also indicated by 132) depending from the footing sections 130B, 131B of the respective wall members 130, 131. The feet 132 are hollow and open upwardly through the first surface of the wall members 130, 131 for receiving material poured to form the floor 12 whereby the weight of the floor is supported by the floor material within the feet and not by the wall members. Desirably, the feet 132 are configured the same as the feet 32 described above with respect to the drainage tiles 10, 10' so the feet 132 of the corner drainage tile 110 provide flow channels 140 and nest with feet 32 of adjacent drainage tiles 10, 10' in the manner described above. The wall member 130 has feet 132 arranged in an array extending across substantially the full width and length of the bottom surface of the footing section 130B. On the other hand, the wall member 131 has feet arranged in an array extending across only a portion 135 (the "foot portion") of the bottom surface of the footing section 131B. The footing section 131B includes an overlap portion 137 adjacent the foot portion 135 configured for overlapping the footing section 130B to permit folding of the drainage tile 110 about the hinge 129. The bottom surface of the overlap portion 137 is configured to permit sliding of the overlap portion across the upper surface of the footing section 130B. So long as the wall members 130, 131 are bent to a minimum relative angle with respect to each other, the overlap portion 137 completely closes the gap so no concrete can obstruct flow of water under the footing portions 130B, 131B. The overlap portion 137 is free from feet 132 (e.g., substantially free from downward protrusions), which would prevent close conformance of the footing sections 130B, 131B or require nesting with the footing section 130B for close conformance. Because there are no feet 132 on the overlapping portion 137, the folded configuration of the corner drainage tile 110 is not predetermined as would be required by nesting of feet. The overlapping portion 137 can slide across the upper surface of the footing section 130B to an infinite number of overlapping positions for folding the corner drainage tile to correspond to a desired corner angle. In other words, the increments by which the portion 137 may overlap the footing section 130B are theoretically infinite. Desirably, the overlapping section 137 has a width W extending from the hinge 129 to the foot portion 135 that is greater than a length L of the footing section 130B to permit a full range of sliding of the overlapping portion on the footing section 130B to form a corner having an angle as small as about 90 degrees (e.g., see FIG. 13).

The wall sections 130A, 131A of the respective wall members 130, 131 also have protrusions in the form of vertical, elongate channels 142 and horizontal, elongate channels 144 spaced along the length of the corner drainage tile 110. It will be appreciated that the vertical and horizontal channels 142, 144 are "connecting protrusions" in the illustrated embodiment. Desirably, the channels 142, 144 are configured the same as the channels 42, 44 described above with respect to the drainage tiles 10, 10' so the channels 142, 144 of the corner drainage tile 110 nest with channels 142, 144 of adjacent drainage tiles 10, 10' in the manner described above for connecting the drainage tiles.

In view of the above description, it will be appreciated that the corner drainage tile 110 facilitates a snug, interference fit of the vertical channel 142 of the corner drainage tile 110 with other drainage tiles 10, 10'. To form a continuous drainage tile system along the footing 16, the right longitudinal edge margin of the right wall member 130 overlaps or is overlapped by a left longitudinal edge margin of the drainage tile 10, and the left longitudinal edge margin of the left wall member 131 overlaps or is overlapped by a right longitudinal edge margin of the drainage tile 10'. It will be understood that the feet 32, 132 and channels 42, 142, 44, 144 nest (and optionally form an interference fit) as described above with respect to the drainage tiles 10, 10' for connecting the corner drainage tile 110 with the adjacent drainage tiles 10, 10'. Overlapping the drainage tiles is convenient to produce an uninterrupted drainage tile system over the full length of the footing 16. It is to be understood that multiple drainage tiles 10, 10', 110 can be secured together, end-to-end in this manner to cover the entire footing 16.

Figure 14:
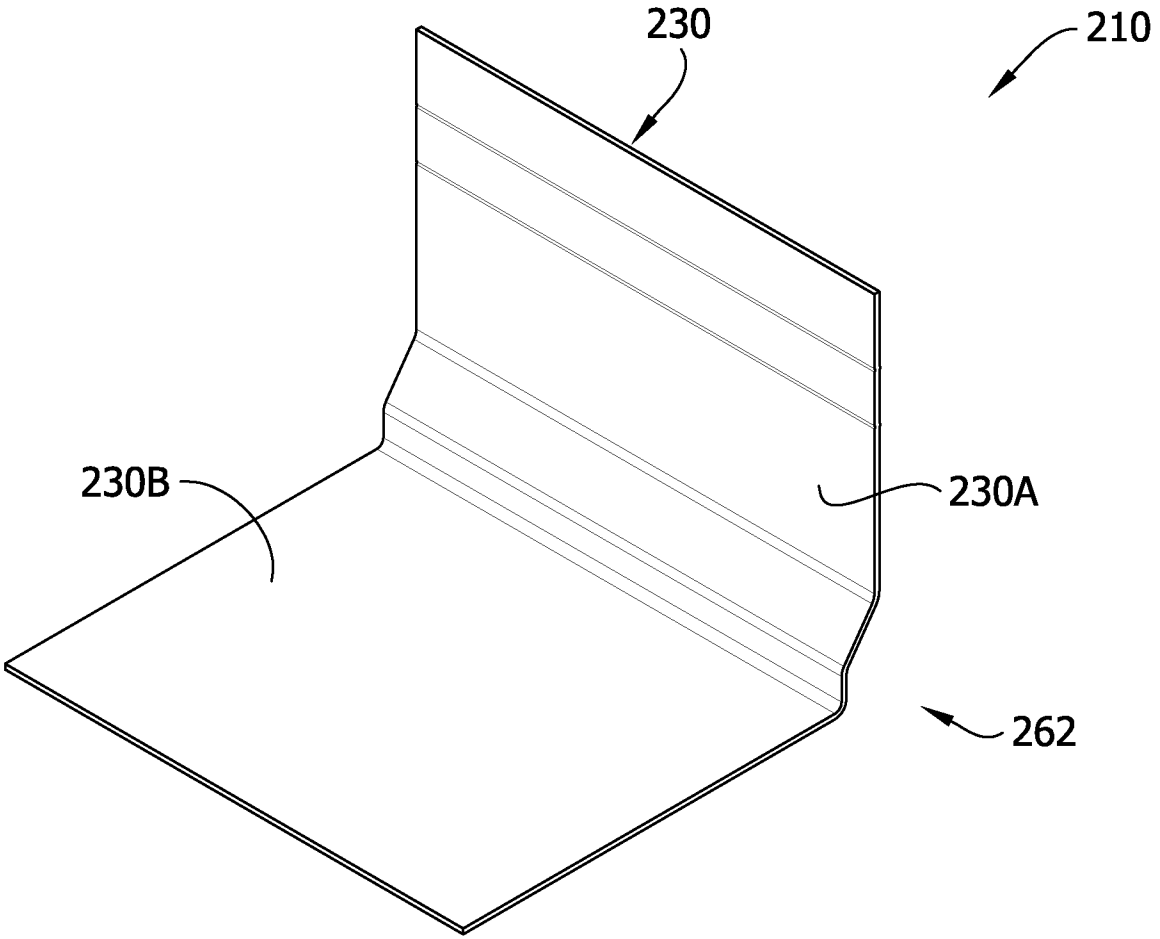
FIG. 14 is a perspective of a bridge drainage tile.
Figure 15:
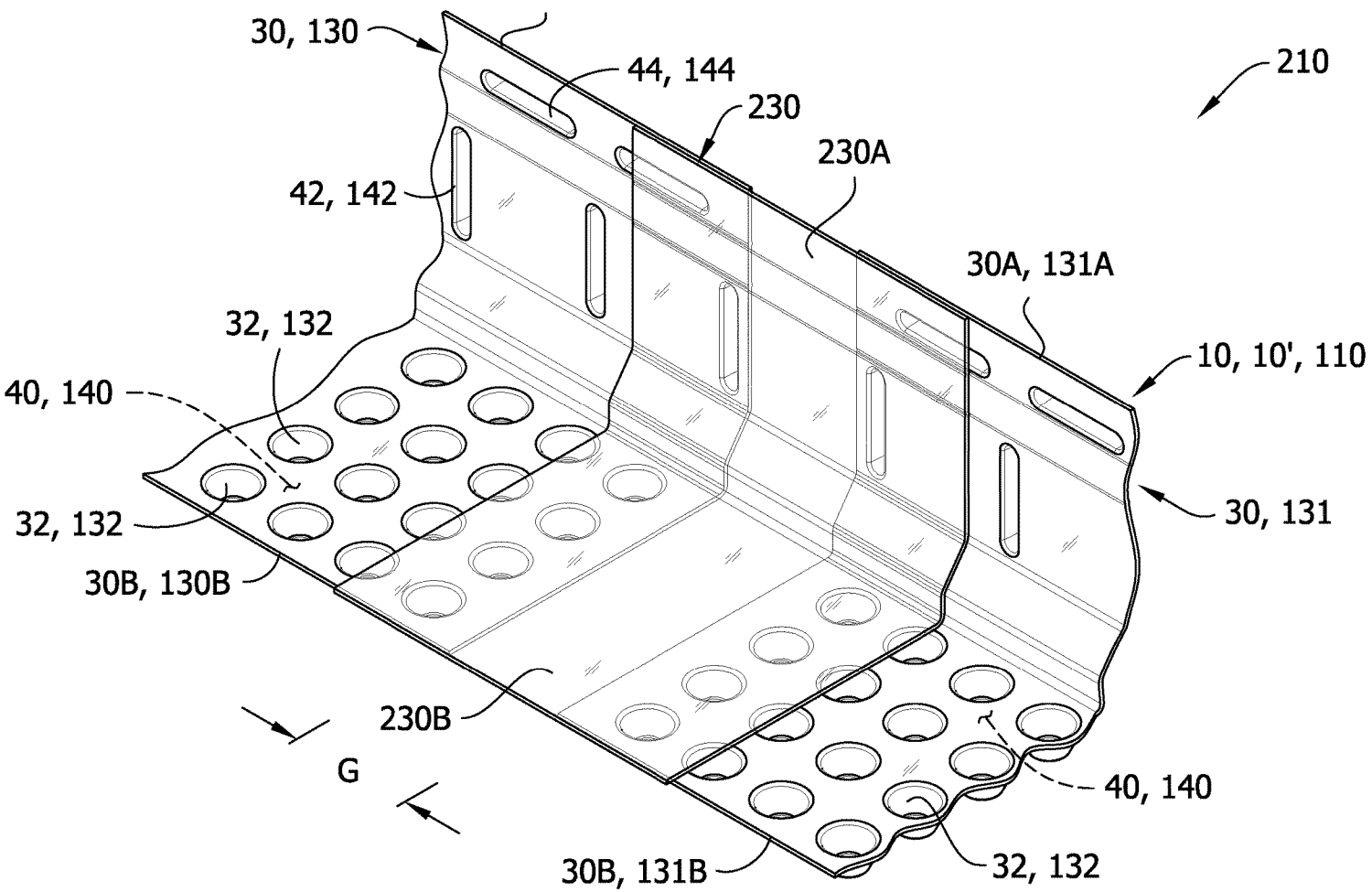
FIG. 15 is a perspective of a drainage tile system including first and second drainage tiles and the bridge drainage tile of FIG. 14 bridging the first and second drainage tiles.

Referring to FIGS. 14 and 15, a bridge drainage tile (broadly, "bridge drainage device") is indicated generally by the reference number 210. The bridge drainage tile 210 can be used to bridge a pair of adjacent drainage tiles 10, 10', or 110. It will be appreciated that in connecting the drainage tiles 10, 10', 110 for form a continuous drainage tile system, certain locations along the continuous drainage tile system may not permit convenient overlapping and nesting of adjacent drainage tiles. The distances are rarely convenient multiples of a standard tile length. Moreover, such a circumstance can arise when a foundation wall 14 has a length that is not a multiple of the increment at which the feet 32, 132 are spaced from each other. The bridge drainage tile 210 can be used to bridge adjacent drainage tiles 10, 10', or 110 (e.g., span a gap G therebetween) where incompatible nesting prevents a conforming overlapping connection of the drainage tiles 10, 10', or 110.

The bridge drainage tile includes a wall member 230 having a wall section 230A and a footing section 230B connected together by a hinge 262. A first surface of the wall member 230 faces generally away from the foundation wall 14 and/or footing 16, and a second surface of the wall member faces generally toward the foundation wall and/or footing. Unlike the drainage tiles 10, 10', 110, the bridge drainage tile is free of protrusions for nesting. For example, the wall section 230A does not have channels like the channels 42, 44, 142, 144, and the footing section does not have feet like the feet 32, 132. However, it is envisioned that at least one side of the bridge drainage tile may have protrusions corresponding to one or both of the channels 42, 44, 142, 144 and feet 32, 132 to facilitate securing the drainage tile in place. The bridge drainage tile is configured to overlap the drainage tiles 10, 10', 110 with non-predetermined, infinite amounts of overlap. The arrangement is such that the second surface of the bridge drainage tile 210 closely conforms to the first surfaces of the drainage tiles 10, 10', 110 which the bridge drainage tile overlaps, no matter the amount of overlap. Desirably, the adjacent drainage tiles 10, 10', 110 having the gap G therebetween are configured to minimize the size of the gap (e.g., trimmed) to be spanned by the bridge drainage tile 210. For example, the gap G bridged by the bridge drainage tile is desirably less than about 2 inches, more desirably less than about 1.5 inches, and even more desirably less than about 1 inch. It will be appreciated that the bridge drainage tile 210 is supported above the footing 16 by the drainage tiles 10, 10', 110 which the bridge drainage tile overlaps. When the concrete floor 14 is poured, the bridge drainage tile 210 assists in preventing concrete from entering the gap between the drainage tiles 10, 10', 110 bridged by the bridge drainage tile to prevent the concrete from obstructing the flow path along the continuous drainage tile system. The bridge drainage tile 210 is preferably sized to extend outwardly beyond the footing 16 so that a portion of the bridge drainage tile 210 covers the rock 20 to permit flow of water between the footing and the rock. The bridge drainage tile 210 can be formed from a thin (e.g., 0.04 in.) single sheet of material (e.g., polyethylene terephthalate glycol-modified, "PETG" plastic). The bridge drainage tile 210 may be formed from a polymeric material or other suitable material which is impervious to water and strong enough to retain its shape after the concrete floor 12 is poured and until the floor sets.

Figure 14A:
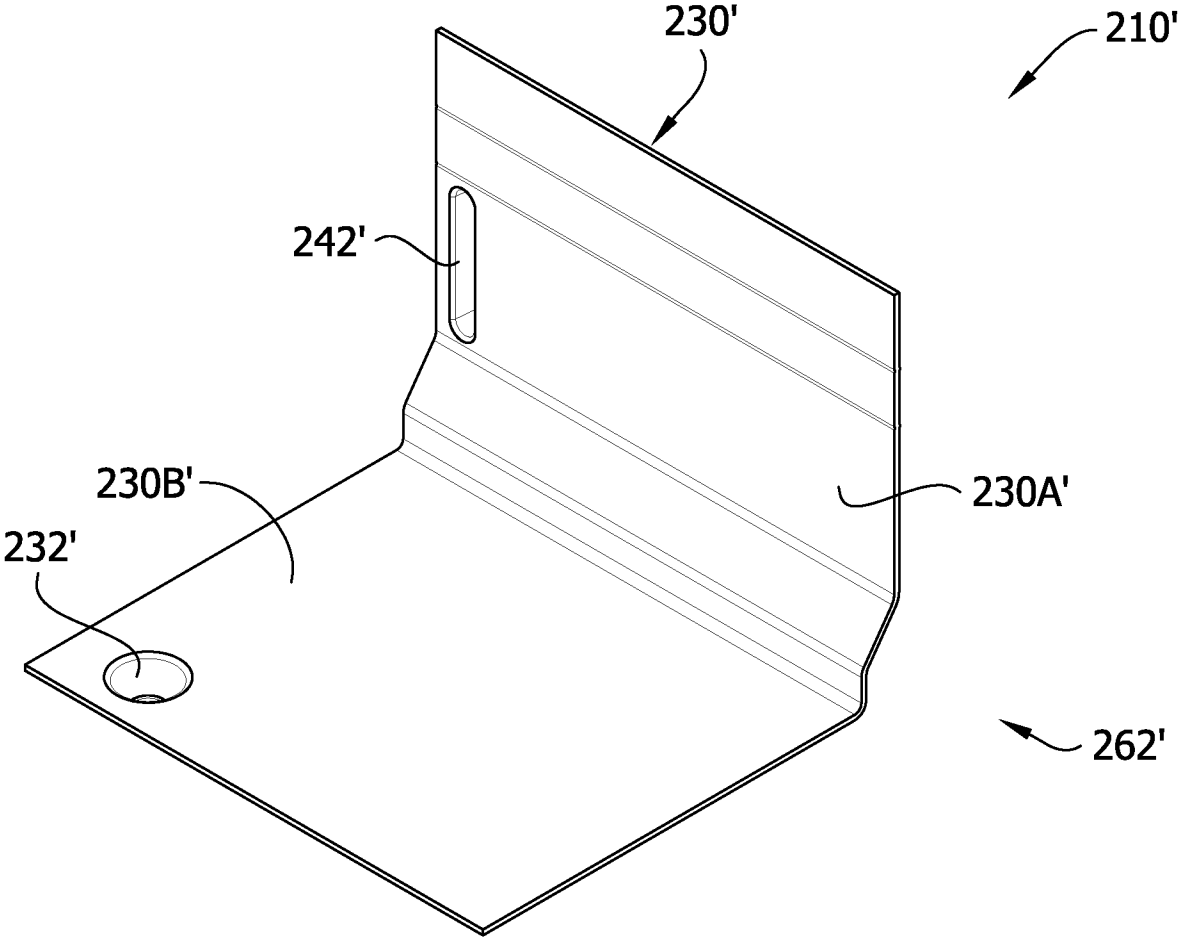
FIG. 14A is a perspective of a bridge drainage tile of a second embodiment.

FIG. 14A shows another version of the drainage tile 210' which has retaining structure for retaining the bridge drainage tile 210' onto one of the two drainage tiles 10, 10', 110. In this embodiment, the retaining structure takes the form of a cup 232' and a channel 242'. Typically only one or the other of the cup 232' and channel 242' would be provided. When the bridge drainage tile is applied to one of the two drainage tiles 10, 10', 110 to be joined together, the cup 232' can be received in a cup 32, 132 of the drainage tile and the channel 242' can be received in a channel 42, 142 of the drainage tile. More preferably, only one of the two retention structures 232', 242' would be provided. This holds the bridge drainage tile in place until concrete is poured. Notably the cup 232' and channel 142' are on one side of the bridge drainage tile 210' for connecting to only one of the two drainage tiles 10, 10', 110 being joined together by the bridge drainage tile. Other forms of retention structure (e.g., a horizontal channel (not shown) corresponding to horizontal channels 44, 144) may be used within the scope of the present invention.

Figure 16:
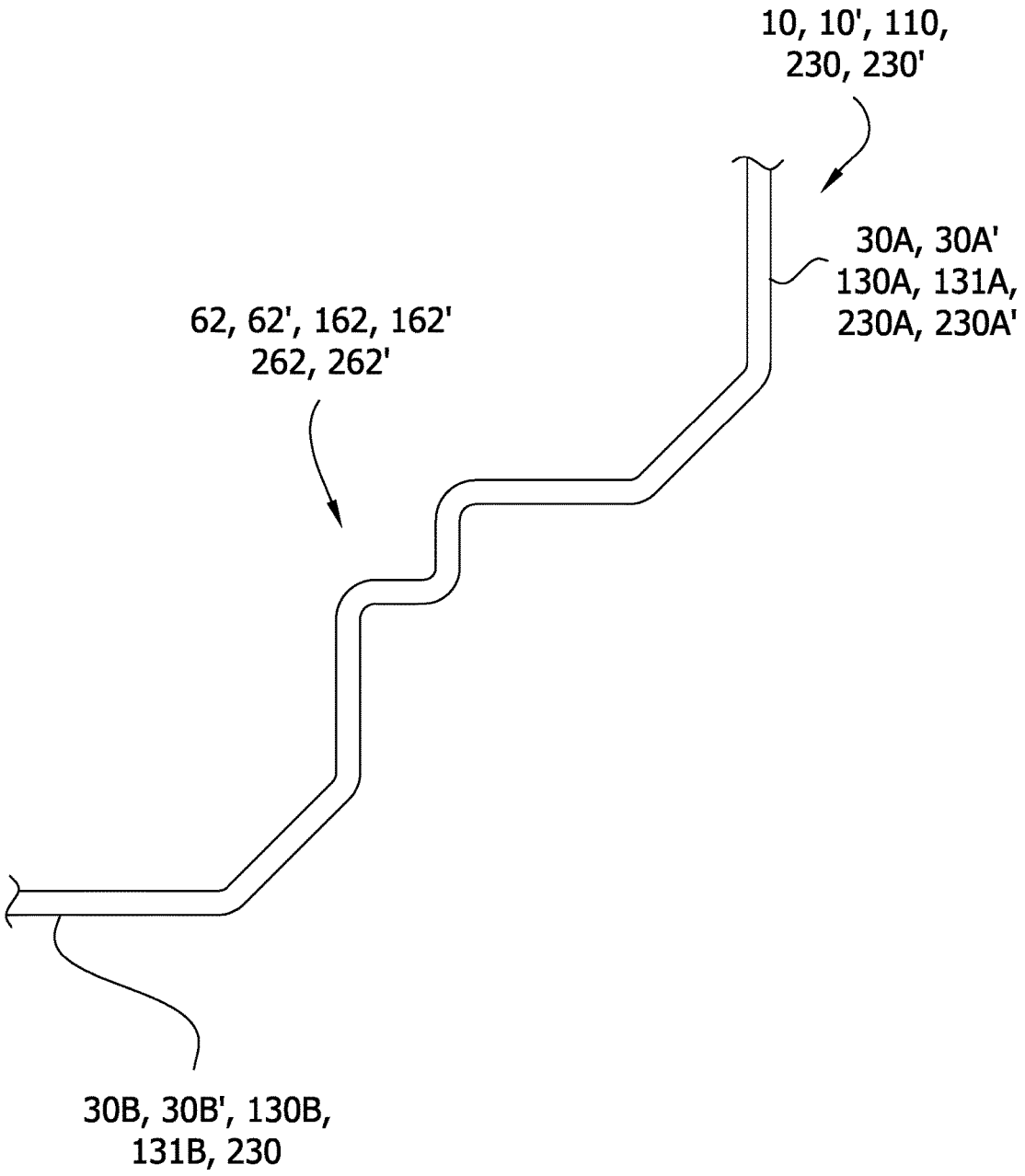
FIG. 16 is an enlarged, fragmentary side elevation showing a hinge connecting a wall section to a foot section of the tiles of the various illustrated embodiments of the present invention.

Another form of the hinge 62, 62', 162, 162', 262, 262' is shown in FIG. 16. The hinge is formed with a generally accordion fold in the middle that permits additional flexibility in bending the wall sections 30A, 30A', 130A, 131A, 230A, 230A' and 30B, 30B', 130B, 131B, 230B, 230B'. Greater flexibility can permit the wall sections to lie more nearly flat against the foundation wall and the footing.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A corner drainage device comprising:

a first wall member having a foundation section and a footing section, a second wall member having a foundation section and a footing section, a first hinge joining the first and second wall members, the first hinge configured to permit pivoting of one of the first and second wall members relative to the other of the first and second wall members to form a corner at the first hinge, and wherein the footing section of the second wall member includes:

a foot portion comprising one or more feet projecting downward, and an overlap portion free of feet and configured to overlap the footing section of the first wall member when the first hinge forms the corner, the overlap portion configured to overlap the footing section of the first wall member in closely conforming engagement at infinite increments of overlap to permit formation of the corner at the first hinge.

2. The corner drainage device as set forth in claim 1 wherein the overlap portion is located closer to the footing section of the first wall member than the foot portion.

3. The corner drainage device as set forth in claim 1 wherein the first hinge comprises a fold located at a junction of the foundation section of the first wall member and the foundation section of the second wall member.

4. The corner drainage device as set forth in claim 3 wherein the first and second wall members are formed as a single piece of material.

5. The corner drainage device as set forth in claim 3 further comprising a gap between the footing section of the first wall member and the footing section of the second wall member.

6. The corner drainage device as set forth in claim 5 wherein the gap increases in width from the foundation sections of the first and second wall members toward free edges of the footing sections of the first and second wall members when the first and second foundation sections are in a co-planar relation.

7. The corner drainage device as set forth in claim 5 further comprising a second hinge for each of the wall members, the second hinge interconnecting the foundation section and the footing section of the respective first or second wall member.

8. The corner drainage device as set forth in claim 7 wherein the gap separates the second hinge of the first wall member from the second hinge of the second wall member.

9. A corner drainage device comprising:

a first wall member having a foundation section and a footing section, a second wall member having a foundation section and a footing section, a first hinge joining the first and second wall members, the first hinge configured to permit pivoting of one of the first and second wall members relative to the other of the first and second wall members to form a corner at the first hinge, and wherein the footing section of the second wall member includes a substantially planar overlap portion having a different configuration than the footing section of the first wall member, the overlap portion being configured to overlap the footing section of the first wall member when the first hinge forms the corner, the overlap portion configured to overlap the footing section of the first wall member in closely conforming engagement at infinite increments of overlap to permit formation of the corner at the first hinge.

10. The corner drainage device as set forth in claim 9 wherein the footing section of the second wall member further comprises a foot portion that has a different configuration than the overlap portion of the footing section of the second wall member.

11. The corner drainage device as set forth in claim 10 wherein the foot portion of the footing section of the second wall member includes at least one downwardly projecting foot for spacing the footing section off of a footing of a building.

12. The corner drainage device as set forth in claim 9 wherein the footing section of the second wall member comprises a foot portion and the overlap portion, the overlap portion being configured to overlap the footing section of the first wall member when the corner drainage device is bent on the hinge to fit into a corner of a foundation of a building.

13. The corner drainage device as set forth in claim 12 wherein the foot portion comprises feet projecting downward for engaging a footing of the building foundation to space a remainder of the footing section from the footing, and the overlap portion is free of feet projecting downward from the overlap portion.

14. The corner drainage device as set forth in claim 13 wherein the overlap portion is located closer to the footing section of the first wall member than the foot portion.

15. The corner drainage device as set forth in claim 9 wherein the first hinge comprises a fold located at a junction of the foundation section of the first wall member and the foundation section of the second wall member.

16. The corner drainage device as set forth in claim 15 wherein the first and second wall members are formed as a single piece of material.

17. The corner drainage device as set forth in claim 15 further comprising a gap between the footing section of the first wall member and the footing section of the second wall member.

18. The corner drainage device as set forth in claim 17 wherein the gap increases in width from the foundation sections of the first and second wall members toward free edges of the footing sections of the first and second wall members when the first and second foundation sections are in a co-planar relation.

19. The corner drainage device as set forth in claim 17 further comprising a second hinge for each of the wall members, the second hinge interconnecting the foundation section and the footing section of the respective first or second wall member.

20. The corner drainage device as set forth in claim 19 wherein the gap separates the second hinge of the first wall member from the second hinge of the second wall member.

* * * * *